US011643270B2

(12) United States Patent
Ishida et al.

(10) Patent No.: US 11,643,270 B2
(45) Date of Patent: May 9, 2023

(54) EXTRACTION BAG

(71) Applicant: OHKI CO., LTD., Osaka (JP)

(72) Inventors: Takashi Ishida, Sanda (JP); Mitsunori Saitoh, Takatsuki (JP)

(73) Assignee: OHKI CO., LTD., Osaka (JP)

( * ) Notice: Subject to any disclaimer, the term of this patent is extended or adjusted under 35 U.S.C. 154(b) by 0 days.

(21) Appl. No.: 17/047,413

(22) PCT Filed: Mar. 11, 2020

(86) PCT No.: PCT/JP2020/010487

§ 371 (c)(1),
(2) Date: Oct. 14, 2020

(87) PCT Pub. No.: WO2021/181555

PCT Pub. Date: Sep. 16, 2021

(65) Prior Publication Data

US 2021/0284434 A1 Sep. 16, 2021

(51) Int. Cl.
*B65D 85/812* (2006.01)

(52) U.S. Cl.
CPC ..... *B65D 85/812* (2013.01)

(58) Field of Classification Search
CPC ..... B65D 85/812; B65D 85/808; B65D 85/8085; A47J 31/06
See application file for complete search history.

(56) References Cited

U.S. PATENT DOCUMENTS 3,215,533 A * 11/1965 Rambold ..... B65D 85/812 426/82
3,899,599 A * 8/1975 Rambold ..... B65D 85/812 426/82

(Continued)

FOREIGN PATENT DOCUMENTS

DE 1429248 A1 * 10/1968 ..... B65D 85/812
DE 2236616 A1 * 2/1974 ..... B65D 85/812

(Continued)

OTHER PUBLICATIONS

Definition of "transverse." Oxford English Dictionary retrieved Feb. 15, 2022 <https://www.oed.com/view/Entry/205122?rskey=7mtPD1&result=1&isAdvanced=false#eid>.*

(Continued)

*Primary Examiner* — Viren A Thakur
(74) *Attorney, Agent, or Firm* — Oliff PLC

(57) ABSTRACT

An extraction bag 1A includes a bag main body 3 formed of a water permeable filter sheet 2, a thin plate-like member 10 provided on an outer surface of the bag main body 3, and an extraction material filled in the bag main body 3. The bag main body 3 has a first surface 3A and a second surface 3B opposed to each other, and an upper side 4*a* corresponding to edges thereof. The thin plate-like member 10 includes a first member 10A on the first surface 3A of the bag main body, and a second member 10B on the second surface 3B of the bag main body, and these 10A and 10B are continuous with each other via a first horizontal folding line Lh1 extending along the upper side 4*a*. The thin plate-like member 10 includes a pair of elongated regions 12 (opposed to each other) sandwiching a central bonded portion 11 of the first member 10A from its left and right sides that are provided astride the first member 10A and the second member 10B and are pulled out from the bag main body, and a vertical folding line Lv1 along which the elongated regions 12 can be pulled out. This extraction bag 1 is a tea bag type extraction bag filled with an extraction material such as ground coffee and capable of allowing the bag main body to be easily sunk into the hot water or moved up and down.

16 Claims, 21 Drawing Sheets

(56) References Cited

U.S. PATENT DOCUMENTS

| | | | | | |
|---|---|---|---|---|---|
| T973,014 | I4 * | 8/1978 | Rambold | B65D 85/812 | 206/0.5 |
| 4,715,271 | A * | 12/1987 | Kitagawa | B65D 85/8043 | 210/474 |
| 5,318,786 | A * | 6/1994 | Clarkson | B65D 85/812 | 426/79 |
| 7,128,934 | B1 * | 10/2006 | Ohta | B65D 85/8061 | 426/11 |
| 2004/0168578 | A1 * | 9/2004 | Saitoh | A47J 31/02 | 99/279 |
| 2005/0054259 | A1 * | 3/2005 | Bailey | B65D 85/812 | 446/77 |
| 2005/0092185 | A1 * | 5/2005 | Klinar | B65D 85/812 | 99/279 |
| 2009/0162491 | A1 * | 6/2009 | Burchard | B65D 85/812 | 426/82 |
| 2016/0297604 | A1 * | 10/2016 | Gabler | B65D 85/812 | |

FOREIGN PATENT DOCUMENTS

| | | | | | |
|---|---|---|---|---|---|
| DE | 102004040377 | A1 * | 2/2006 | B65B 29/02 | |
| GB | 2509518 | A * | 7/2014 | B65D 85/812 | |
| JP | S59-069169 | U | 5/1984 | | |
| JP | H02-37024 | U * | 3/1990 | | |
| JP | H04-112059 | * | 9/1992 | | |
| JP | 06115561 | A * | 4/1994 | B65D 85/812 | |
| JP | H08-508660 | A | 9/1996 | | |
| JP | 2003267444 | A * | 9/2003 | | |
| JP | 2004242847 | A * | 9/2004 | | |
| JP | 2005-118239 | A | 5/2005 | | |
| JP | 2006-273379 | A | 10/2006 | | |
| JP | 3140084 | U * | 3/2008 | | |
| JP | 2008-081205 | A * | 4/2008 | | |
| JP | 2019187631 | A * | 10/2019 | | |
| JP | 2019187634 | A * | 10/2019 | | |
| WO | WO-2008038403 | A1 * | 4/2008 | B65D 85/812 | |
| WO | WO 2021044897 | A1 * | 3/2021 | | |

OTHER PUBLICATIONS

Apr. 14, 2020 International Search Report issued in International Patent Application No. PCT/JP2020/010487.

Sep. 6, 2022 International Preliminary Report on Patentability issued in International Patent Application No. PCT/JP2020/010487.

* cited by examiner

1G

EXTRACTION BAG

TECHNICAL FIELD

The present invention relates to an extraction bag for obtaining extraction liquid by immersing an extraction material filled in a bag main body made of a water permeable filter sheet in hot water.

BACKGROUND ART

For the purpose of brewing beverages such as green tea, black tea, and oolong tea in an easy and simple manner, tea bags in which such tea leaves are filled in water permeable bag main bodies having hanging strings have been widely used conventionally. Also for coffee, a tea bag type coffee extraction bag according to which a bag main body filled with ground coffee is immersed in hot water has been used in addition to a drip type extraction bag according to which hot water is poured into ground coffee. When it is attempted to immerse such a tea bag type coffee extraction bag into hot water, however, the bag main body filled with ground coffee is apt to float in the hot water due to carbon dioxide contained in the ground coffee, thus making it difficult to extract coffee sufficiently. In view of this, an extraction bag in which a hooking piece formed by a thin plate-like member is attached to one surface of a bag main body to be filled with ground coffee so that the hooking piece can be hooked onto an edge of a cup in order to prevent the bag main body filled with ground coffee from floating in hot water has been proposed (Patent Literature 1).

It has been also proposed that a handle portion configured to expand and contract like a pantograph by folding a thin plate-like member is attached to a bag main body filled with ground coffee and the extraction of the coffee is facilitated by moving the handle portion up and down in hot water in which the bag main body is immersed (Patent Literature 2).

CITATION LIST

Patent Literature

Patent Literature 1: Japanese Utility Model Registration No. 3140084

Patent Literature 2: Japanese Patent Application Laid-Open No. 2006-273379

SUMMARY OF INVENTION

Technical Problem

In such a conventional coffee extraction bag according to which the bag main body filled with ground coffee is immersed in hot water, however, even when it is attempted to sink the floating bag main body forcibly into the hot water by gripping the hooking piece or the handle portion formed by the thin plate-like member, the thin plate-like member undergoes bending or deflection, thus making it difficult to sink the bag main body into the hot water. Even when the hooking piece or the handle portion is moved up and down in order to facilitate the extraction of the coffee, the bag main body cannot move up and down in the hot water in the same manner as the handle portion. Even if the bag main body temporarily sinks into the hot water, only a surface layer of the entire ground coffee filled in the bag main body swells by hot water, and the hot water is less likely to penetrate into the inside of the entire ground coffee. Thus, it is difficult for such a tea bag type extraction bag according to which the bag main body is immersed in hot water to obtain coffee liquid having a concentration about equal to that of a drip type extraction bag in an amount of time about equal to or less than that of the drip type extraction bag.

In view of this, it is an object of the present invention to provide a tea bag type extraction bag configured to obtain extraction liquid by immersing a bag main body filled with an extraction material such as ground coffee in hot water, capable of allowing the bag main body to be easily sunk into the hot water or moved up and down and capable of allowing the hot water to be distributed through the entire extraction material in the bag main body so as to obtain extraction liquid having a sufficient concentration easily.

Solution to Problem

The present inventor has achieved the present invention by conceiving the following: in a tea bag type extraction bag in which a thin plate-like member is attached to a bag main body filled with an extraction material, the thin plate-like member can be formed into a rigid stick shape extending from a central portion of the bag main body by configuring the thin plate-like member so as to have a particular shape. By gripping the stick-shaped portion, the bag main body can be easily sunk into hot water or moved up and down; moreover, the area of an upper surface of a portion occupied by the extraction material in the bag main body as well as its headspace can be increased; consequently, when the bag main body is moved up and down in the hot water, the hot water flows downwardly with respect to the upper surface of the extraction material in the bag main body, thus facilitating the penetration of the hot water into the inside of the extraction material.

Specifically, the present invention provides an extraction bag including: a bag main body formed of a water permeable filter sheet; a thin plate-like member provided on an outer surface of the bag main body; and an extraction material filled in the bag main body, wherein the bag main body has a first surface and a second surface opposed to each other, and an upper side corresponding to edges of the first and second surfaces;

when the bag main body is developed so that the first surface is located under the upper side and the second surface is located above the upper side, the thin plate-like member includes a first member on the first surface of the bag main body, and a second member on the second surface of the bag main body, and the first member and the second member are continuous with each other via a first horizontal folding line extending along the upper side; and the thin plate-like member includes

- a central bonded portion bonded to the first surface of the bag main body in a central portion of the first member,
- a pair of elongated regions sandwiching the central bonded portion from its left and right sides that are provided astride the first member and the second member and are capable of being pulled out from the bag main body, and
- a vertical folding line along which the pair of elongated regions can be pulled out from sides closer to lateral sides of the bag main body so as to be opposed to each other.

The present invention also provides a hand-filled extraction bag in which the bag main body in the above-described extraction bag is unfilled with the extraction material and an opening for filling an extraction material is provided in the bag main body.

Advantageous Effects of Invention

According to the present invention, by folding the pair of elongated regions of the thin plate-like member provided on the outer surface of the bag main body filled with the extraction material so as to be opposed to each other, the pair of elongated regions suppress deflection with respect to each other and have a rigid stick shape extending from the one surface of the bag main body. Thus, the bag main body can be easily sunk into hot water or moved up and down by gripping such a stick-shaped portion. Consequently, the hot water can easily run through the bag main body.

Moreover, since the pair of elongated regions are provided across the two surfaces of the bag main body opposed to each other, the stick-shaped portion obtained by forming such elongated regions into a stick shape has a longer length as compared to a stick shape formed by a pair of elongated regions provided only on one surface of the bag main body. Thus, the hand gripping the stick-shaped portion can be prevented from getting hot by steam when the bag main body in the hot water is sunk or moved up and down by gripping the stick-shaped portion.

Furthermore, according to the present invention, the shape of the portion occupied by the extraction material in the bag main body can be changed so as to increase the area of its upper surface, and its headspace can be also increased by gripping the stick-shaped portion in such a manner as to be inclined. Consequently, hot water flowed into the bag main body is more likely to flow downwardly from the upper surface of the extraction material. Thus, extraction not only from the surface of the portion occupied by the extraction material in the bag main body but also from the entire extraction material can be facilitated. In particular, in an aspect in which the second surface of the bag main body is pulled up by a central pull-up portion of the thin plate-like member, flattening of the bag main body as a result of the bag main body being pulled in a downward direction due to the weight of the extraction material can be prevented also by the pulling up of the bag main body by the central pull-up portion, thus increasing the headspace. According to an aspect in which a reinforced portion extending in a width direction of the bag main body is further provided below the stick-shaped portion, contraction of the bag main body in the width direction thereof can be prevented from occurring, thus expanding the whole space in the bag main body.

Therefore, the present invention can increase the extraction rate, and thus enables extraction liquid having a concentration about equal to or higher than that of a drip type extraction method to be obtained easily in a short amount of time.

DESCRIPTION OF EMBODIMENTS

Figure 1A:
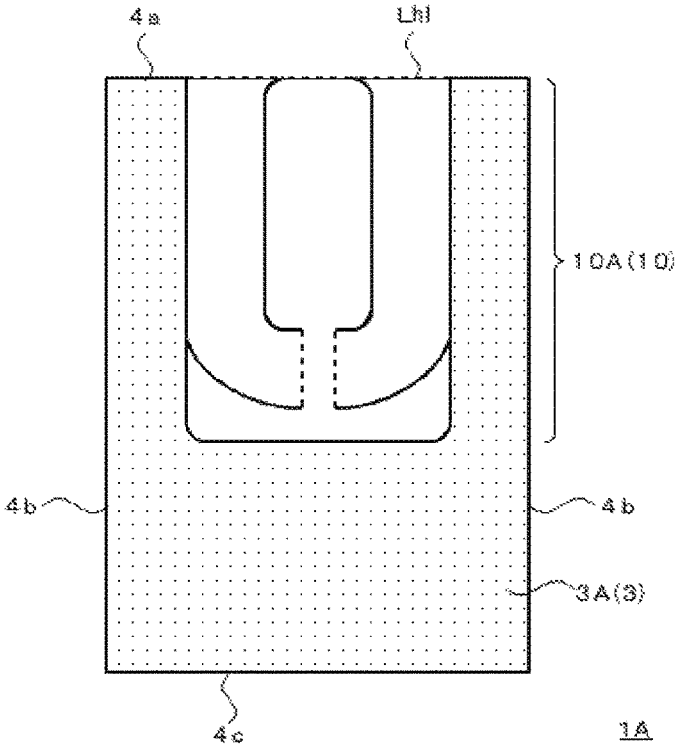
FIG. 1A is a front view of an extraction bag 1A (a plan view illustrating a first member side) according to an embodiment.

The present invention will be specifically described below with reference to the drawings. Note that the same reference signs in the drawings denote the identical or equivalent components.

General Configuration

Figure 1B:
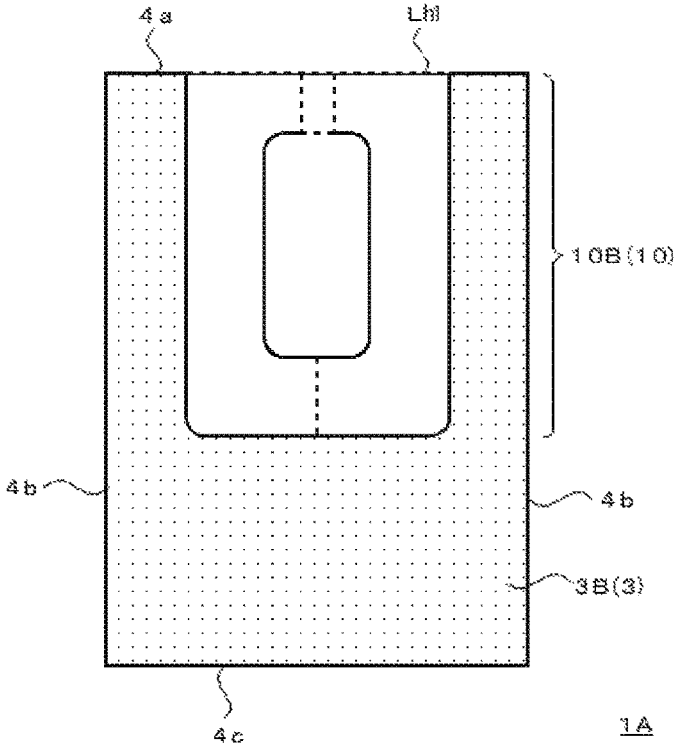
FIG. 1B is a rear view of the extraction bag 1A (a plan view illustrating a second member side) according to the embodiment.
Figure 4A:
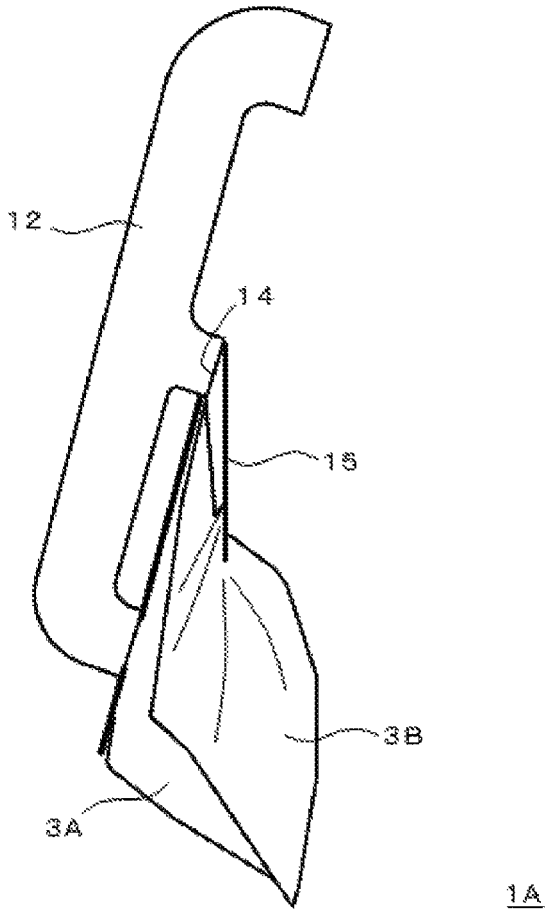
FIG. 4A is a side view illustrating the extraction bag 1A according to the embodiment with elongated regions being pulled out.
Figure 4B:
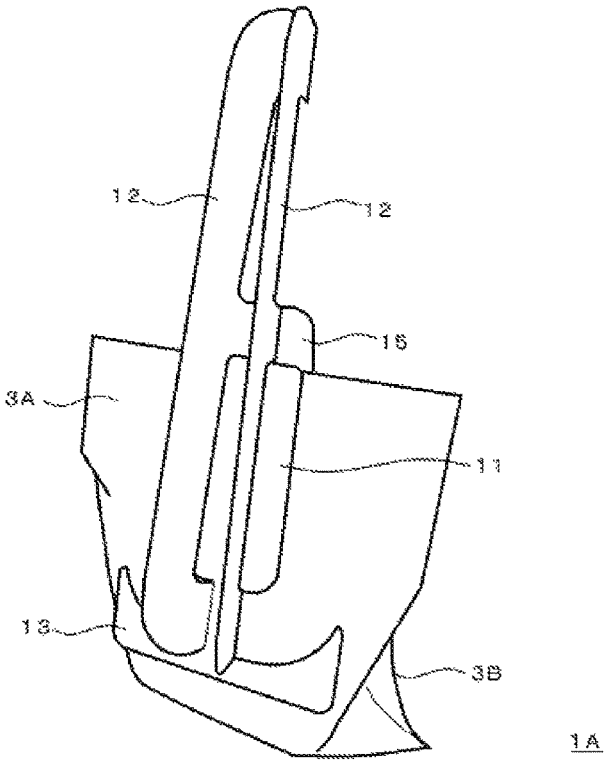
FIG. 4B is a perspective view illustrating the extraction bag 1A according to the embodiment with the elongated regions being pulled out, as viewed from a first surface side of the bag main body.
Figure 4C:
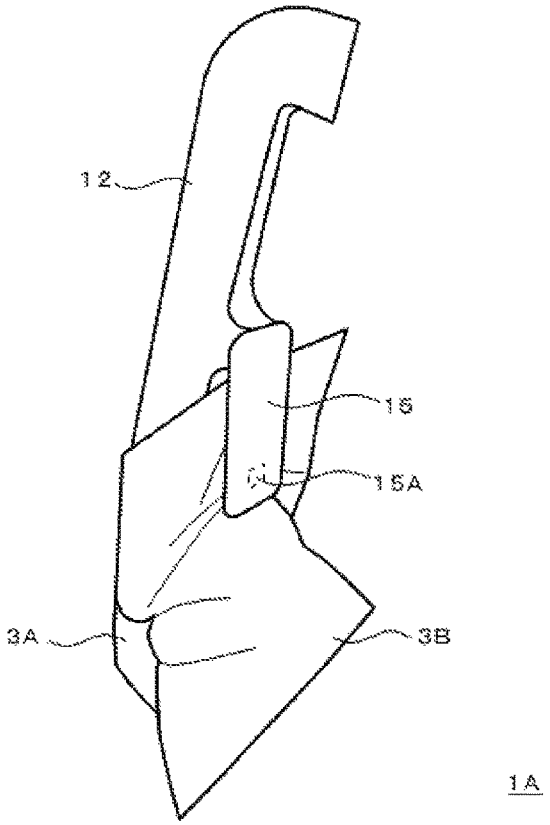
FIG. 4C is a perspective view illustrating the extraction bag 1A according to the embodiment with the elongated regions being pulled out, as viewed from a second surface side of the bag main body.

FIGS. 1A and 1B are a front view (a plan view illustrating a first member side) and a rear view (a plan view illustrating a second member side), respectively, illustrating an extraction bag 1A with elongated regions of a thin plate-like member not being pulled out according to an embodiment of the present invention. FIG. 4A is a side view illustrating the extraction bag 1A with the elongated regions of the thin plate-like member being pulled out. FIG. 4B is a perspective view illustrating the extraction bag 1A as viewed from a first surface side of a bag main body. FIG. 4C is a perspective view illustrating the extraction bag 1A as viewed from a second surface side of the bag main body.

The extraction bag 1A includes: the bag main body 3 constituted of a flat bag formed by a water permeable filter sheet; the thin plate-like member 10 provided on an outer surface of the bag main body 3; and an extraction material filled in the bag main body 3. The bag main body 3 has a first surface 3A and a second surface 3B opposed to each other, and an upper side 4*a* corresponding to edges of these surfaces. The upper side 4*a* in the present embodiment corresponds to a mountain fold between the first surface 3A and the second surface 3B.

Figure 2:
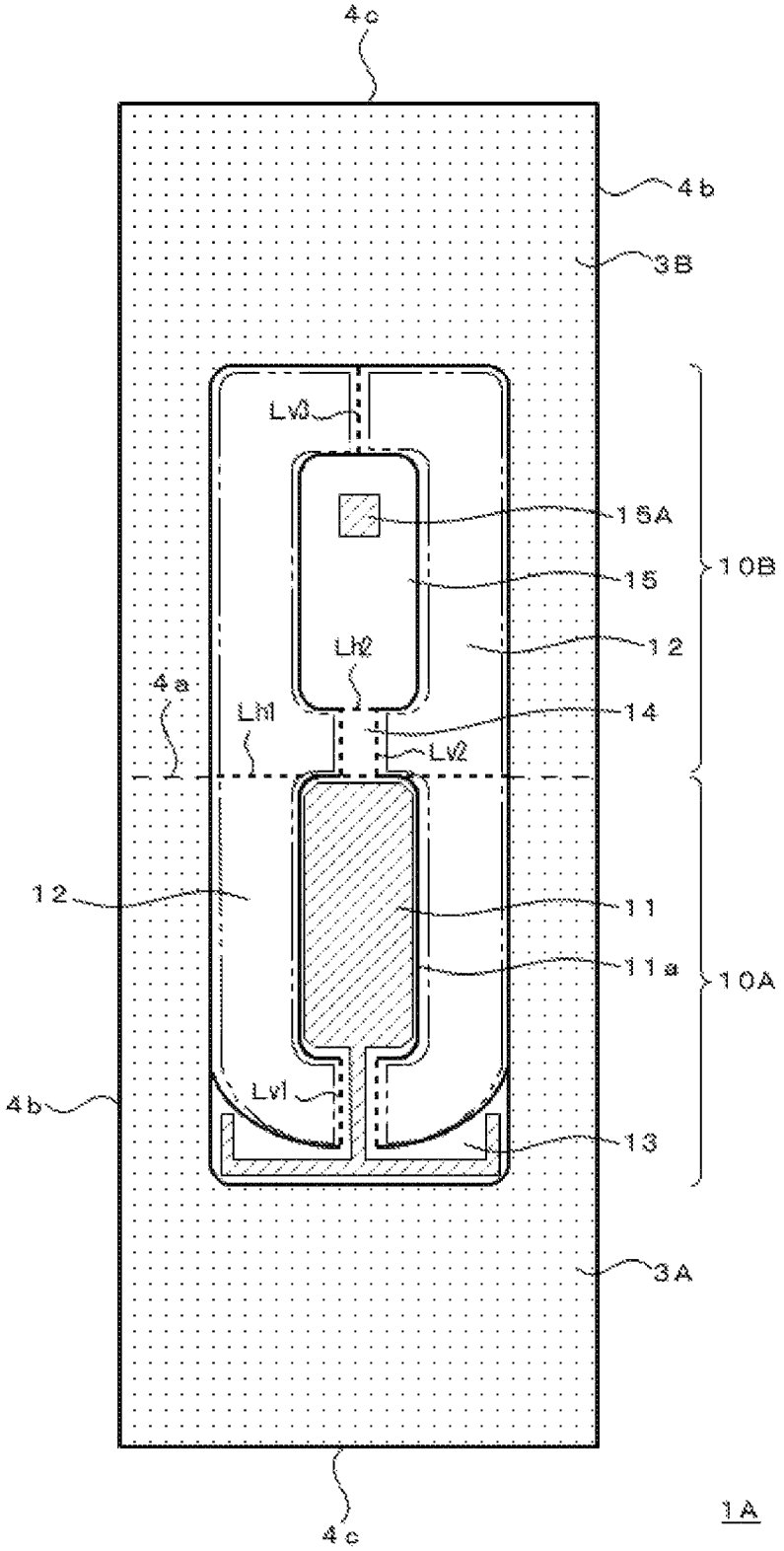
FIG. 2 is a developed view of the extraction bag 1A according to the embodiment.

FIG. 2 is a developed view of the extraction bag 1A. On the lower side of the figure from the upper side 4*a*, the first surface 3A of the bag main body and a first member 10A of the thin plate-like member 10 provided on the first surface 3A are shown. On the upper side of the figure from the upper side 4*a*, the second surface 3B of the bag main body and a second member 10B of the thin plate-like member 10 provided on the second surface 3B are shown. In this figure, a region filled with oblique lines represents a bonded region between the thin plate-like member 10 and the bag main body 3, and a region filled with dots represents a portion where the bag main body 3 is exposed in the developed view. Note that the bonded region in the present invention is not limited to the illustrated aspect.

The first member 10A and the second member 10B are continuous with each other via a first horizontal folding line Lh1. The first horizontal folding line Lh1 overlaps with the upper side 4*a* of the bag main body, and extends along the upper side 4*a*.

A central bonded portion 11 bonded to the first surface 3A of the bag main body is formed in a central portion of the first member 10A. The bonded region of the central bonded portion 11 preferably includes at least a region near the first horizontal folding line Lh1. In the present embodiment, an approximately entire surface of the central bonded portion 11 is bonded to the bag main body 3.

The thin plate-like member 10 includes a pair of elongated regions 12 (regions surrounded by long dashed double-short dashed lines in FIG. 2) sandwiching the central bonded portion 11 from its left and right sides. The elongated regions 12 are formed astride the first member 10A and the second member 10B, and are capable of being pulled out from the bag main body 3.

The thin plate-like member 10 is provided with vertical folding lines along which the pair of elongated regions 12 can be pulled out from sides closer to lateral sides 4*b* of the bag main body so as to be opposed to each other as shown in FIGS. 4A, 4B, and 4C. The vertical folding lines extend in the long-side direction of the elongated regions 12, and serve as rotary axes of a pulling out operation when the pair of elongated regions 12 are pulled out. Note that the vertical folding lines along which the pair of elongated regions 12 can be pulled out so as to be opposed to each other in the present invention are not limited to those formed strictly in the long-side direction of the elongated regions or the up-and-down direction of the bag main body. The vertical folding line may be formed obliquely to the long-side direction of the elongated regions 12 as in a fourth vertical folding line Lv4 to be described later. On the other hand, it is preferable in the present invention that a pair of such vertical folding lines be formed at least in the first member 10A. It is more preferable that at least a pair of such vertical folding lines be formed also in the second member 10B. It is yet more preferable that a vertical folding line of the second member 10B be formed as an extension of a vertical folding line of the first member 10A. In the present embodiment, since right and left lateral sides 11*a* of the central bonded portion 11 in the first member 10A are separated from the elongated regions 12, a pair of first vertical folding lines Lv1 are formed in the first member 10A at ends of the elongated regions 12 disposed closer to a lower side 4*c* of the bag main body than the central bonded portion 11. Moreover, a pair of second vertical folding lines Lv2 extending from the first horizontal folding line Lh1 are formed in the second member 10B. Furthermore, a third vertical folding line Lv3 is formed in a portion where ends of the pair of elongated regions 12 are continuous with each other.

Note that the horizontal folding line Lh1 and the vertical folding lines Lv1, Lv2, and Lv3 of the thin plate-like member 10 can be formed, for example, by perforation, half cutting, or creasing.

Configuring the pair of elongated regions 12 extending across the first member 10A and the second member 10B to be capable of being pulled out from the bag main body 3 along the vertical folding lines so as to be opposed to each other is a characteristic configuration of the present invention. The pair of elongated regions 12 pulled out from the bag main body 3 can serve as a long rigid stick-shaped handle when the extraction material in the bag main body 3 is sunk into hot water.

In the present embodiment, the first member 10A includes a reinforced portion 13 bonded to the bag main body 3 in a region closer to the lower side 4*c* of the bag main body than lower end portions of the elongated regions 12 (FIG. 2). Consequently, the vertical folding lines Lv1, which serve as the axes of the pulling out operation, at the lower end portions of the elongated regions 12 are interposed between the central bonded portion 11 and the reinforced portion 13, thereby improving the strength of the lower end portions. Moreover, the reinforced portion 13 extends in the width direction of the bag main body. This can prevent the contraction of the bag main body in its width direction due to the weight of the extraction material, thus ensuring a wide space in the bag main body 3. Note that the reinforced portion 13 is provided as necessary in the present invention.

The second member 10B in the present embodiment, on the other hand, includes a central upper end portion 14 extending from the first horizontal folding line Lh1 between the pair of elongated regions 12. The central upper end portion 14 is continuous with the elongated regions 12 via the second vertical folding lines Lv2, and floated without being bonded to the bag main body 3. The second member 10B also includes a central pull-up portion 15 continuous with the central upper end portion 14 via a second horizontal folding line Lh2. The central pull-up portion 15 is separated from the elongated regions 12. Moreover, the central pull-up portion 15 includes a bonded region 15A bonded with the bag main body at a portion distant from the central upper end portion 14. Thus, when the pair of elongated regions 12 are pulled out from the bag main body 3 so as to be opposed to each other, a central portion of the second surface 3B of the bag main body is pulled up in the direction of the upper side 4*a* of the bag main body as shown in FIGS. 4A and 4C. This increases the area of an upper surface of the portion occupied by the extraction material in the bag main body, and also increases its headspace. Therefore, the extraction material can be efficiently extracted with hot water flowed into the bag main body, and an amount of time required to obtain extraction liquid having a predetermined concentration can be reduced.

Extraction Material

Examples of the extraction material filled in the bag main body 3 may include ground coffee, tea leaves such as black tea or green tea, and Chinese herbs. When ground coffee is filled in the bag main body 3 and it is attempted to immerse such a bag main body into hot water, the bag main body is generally apt to float due to carbon dioxide contained in the ground coffee, thus making extraction difficult. According to the present invention, however, the bag main body 3 can be forcibly sunk into hot water in a cup or moved up and down in the hot water in an easy manner by pulling out the elongated regions 12 so as to have a rigid stick shape and using the stick-shaped portion as a handle extending from the central portion of the bag main body 3. This allows the hot water to penetrate into not only a surface layer of the entire ground coffee in the bag main body but also the inside of the entire ground coffee, thus making it possible to obtain extraction liquid efficiently from the entire ground coffee. With regard to an extraction material other than ground coffee, hot water can be similarly allowed to permeate the extraction material, so that extraction liquid can be obtained efficiently from the entire extraction material.

Since the extraction bag of the present invention is used with the extraction material being sealed in the bag main body 3, no extraction material is spread into the outside of the bag main body during the use of the extraction bag.

Bag Main Body

The bag main body 3 in the present embodiment has a shape of a flat bag having the upper side corresponding to the mountain fold of the water permeable filter sheet and three sealed sides. The shape of the bag main body 3 in the present invention is not limited to such a flat bag. For example, a gusset bag having a gusset at its bottom or side may be used. Moreover, the upper side 4*a* of the bag main body 3 is not limited to a mountain fold, but may be a sealed side. In consideration of the producing method of the extraction bag, however, it is preferable that the upper side be a mountain fold.

Net planar dimensions of the bag main body 3 can be set appropriately in accordance with the size of a cup or a container used when obtaining extraction liquid using the extraction bag. For example, the bag main body 3 may have a size suitable for a commercially-available coffee cup.

Water Permeable Filter Sheet

A variety of sheets having water permeability and filterability so as to be used for extracting an extraction material can be employed as a water permeable filter sheet for forming the bag main body. A constituent material of the water permeable filter sheet can also be selected appropriately in accordance with a type of the extraction material. For example, synthetic fibers such as polyester, nylon, polyethylene, polypropylene, and vinylon; semisynthetic fibers such as rayon; woven fabrics or non-woven fabrics made of natural fibers, such as *Broussonetia papyrifera* and *Edgeworthia papyrifera*, used alone or as composite fibers; mixed paper, or the like, made of Manila hemp, wood pulp, a polypropylene fiber, or the like; and paper materials such as a tea bag base sheet have been generally known as water permeable filter sheets for extracting beverages. These water permeable filter sheets can be used also in the present invention. In terms of the disposability of a used extraction bag, the water permeable filter sheet preferably contains biodegradable fiber. Examples of such biodegradable fiber may include polylactic acid, polybutylene succinate, and polyethylene succinate. In terms of imparting transparency to the water permeable filter sheet so that the state of the extraction material in the bag main body can be seen, it is preferable that a content of an inorganic pigment be reduced or no inorganic pigment be contained.

Whereas hot water is directly poured into an extraction material in a drip type extraction bag, hot water is always supplied to the extraction material through the water permeable filter sheet according to the extraction bag of the present invention. Thus, as far as no powder leakage of the extraction material occurs, it is preferable to employ a water permeable filter sheet having meshes larger than those of the water permeable filter sheet used in the drip type extraction bag. When the extraction material is ground coffee, for example, the air permeability of the water permeable filter sheet can be set to 130 to 600 $cm^3/cm^2/sec$ (Method A of JIS LH1096 for air permeability (the method using a Frazier air permeability tester)).

Thin Plate-Like Member

The thin plate-like member preferably has water repellency. The thin plate-like member can be formed by punching a thin plate-like material such as a paper board having a surface on which a resin is laminated, or a plastic sheet. In terms of the disposability of the used extraction bag 1A, it is preferable that the thin plate-like member be formed of a biodegradable material such as polylactic acid, polybutylene succinate, and polyethylene succinate.

Method of Use

Figure 3:
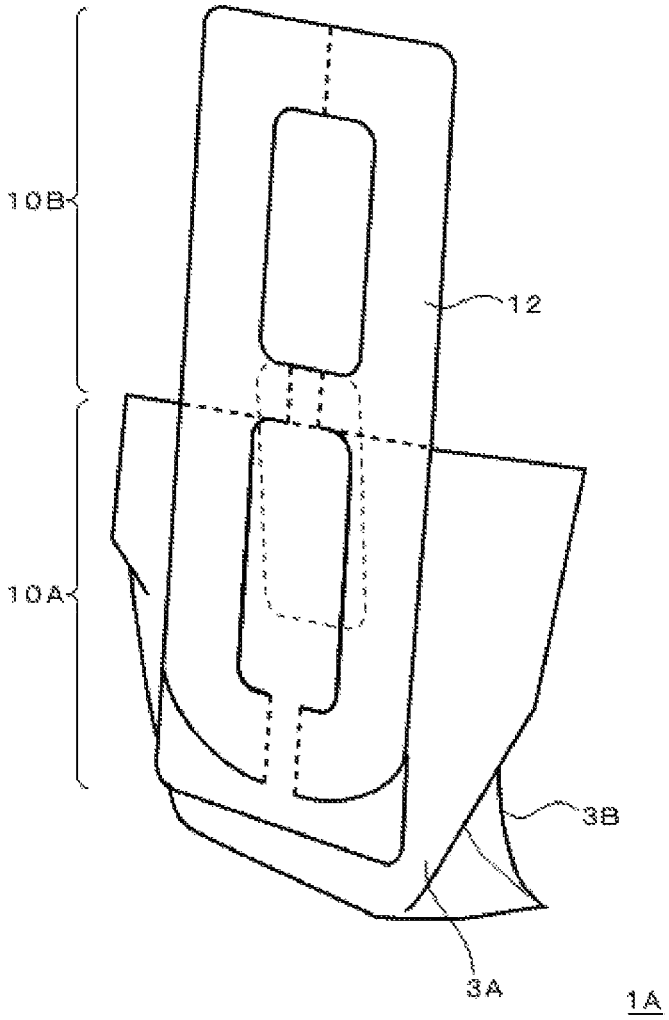
FIG. 3 is a perspective view illustrating the extraction bag 1A with the second member of a thin plate-like member being pulled up from a second surface of a bag main body.

As a packaging and distribution form of the extraction bag 1A, it is preferable that the entire thin plate-like member 10 be provided on the surfaces of the bag main body 3 and the bag main body be flattened as shown in FIGS. 1A and 1B. As a method of use starting from such a state, the second member 10B of the thin plate-like member is first pulled out from the second surface 3B of the bag main body so that the first member 10A and the second member 10B are approximately in the same plane as shown in FIG. 3. At this time, the bonded region 15A (FIG. 2) of the central pull-up portion 15 on the second surface 3B of the bag main body is pulled up in the direction of the upper side 4*a*, thereby changing the shape of the bag main body 3 from the flattened state to a state in which the first surface 3A is bent. This increases the area of the upper surface of the portion occupied by the extraction material in the bag main body, and also increases its headspace.

Thereafter, the thin plate-like member is folded along the first vertical folding lines Lv1, the second vertical folding lines Lv2, and the third vertical folding line Lv3 so that the pair of elongated regions 12 are opposed to each other as shown in FIG. 4B. Consequently, the pair of elongated regions 12 have a long rigid stick shape. The extraction bag is put into a container such as a cup by gripping such a stick-shaped portion, and hot water is poured into the container. Alternatively, the extraction bag is put into a container filled with hot water. The extraction rate of the extraction material can be increased by sinking the bag main body into the hot water or moving the bag main body up and down in the hot water with the stick-shaped portion formed by the elongated regions 12. At this time, a part of the stick-shaped portion having a length extending across the first surface 3A and the second surface 3B of the bag main body that is formed by the elongated regions 12 of the first surface 3A is fixed to the first surface 3A, and a part of the stick-shaped portion that is pulled out from the second surface 3B is located above the upper side 4*a* of the bag main body 3. Since the part of the stick-shaped portion that is located above the upper side 4*a* of the bag main body 3 can be gripped by hand, the hand gripping the stick-shaped portion can be prevented from getting hot by steam even when very hot water is in the container. Of course, extraction may be performed with cold water as necessary. Alternatively, the bag main body may be left in a container such as a cup with the stick-shaped portion leaning against an inner wall of the container.

The bag main body after the extraction can be taken out from the container by gripping the stick-shaped portion.

According to such an extraction bag 1A, extraction liquid having a desired concentration can thus be obtained easily and speedily.

Producing Method

Figure 5:
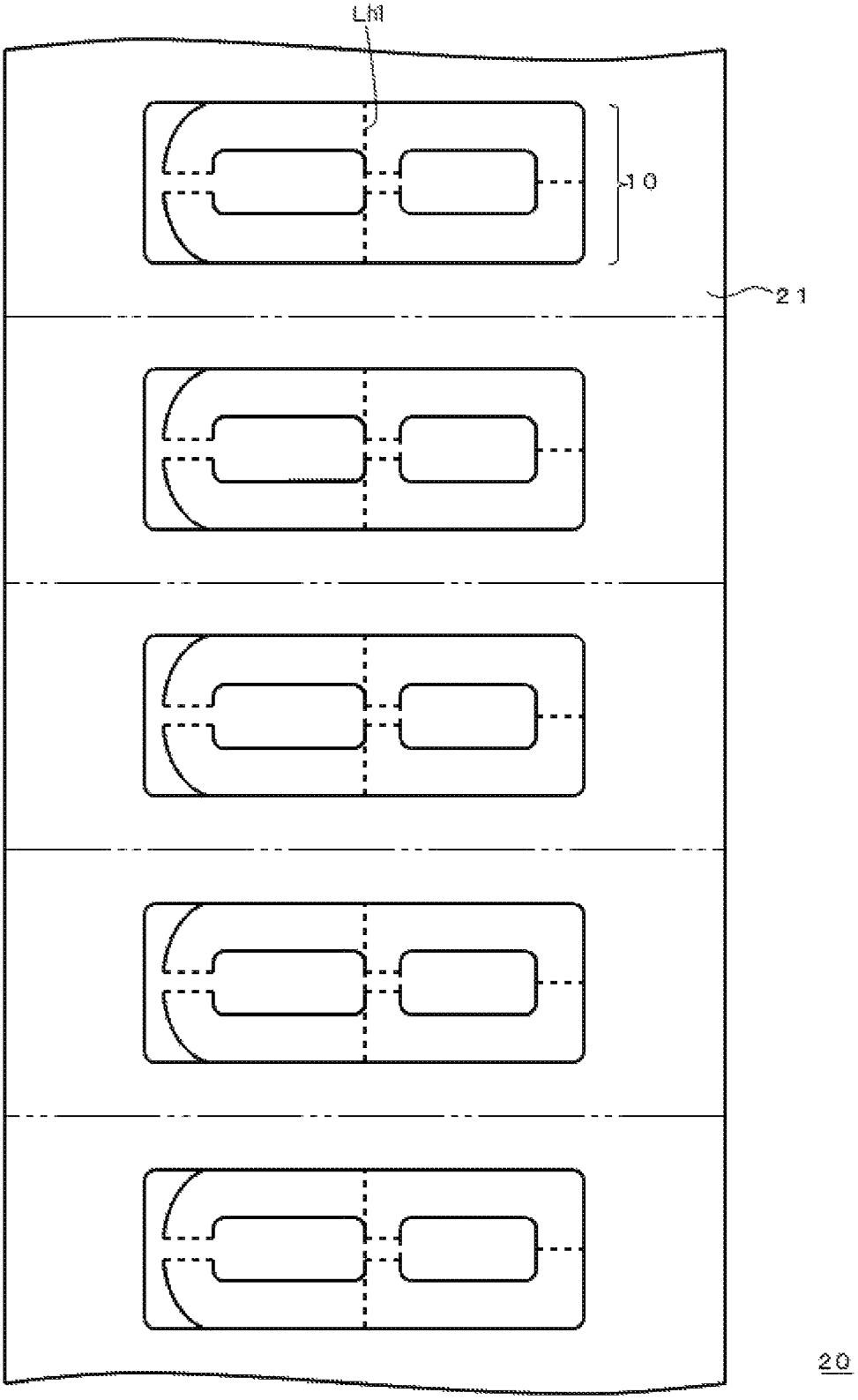
FIG. 5 is a plan view illustrating a sheet for producing extraction bags.

As a method of producing the extraction bag 1A, a sheet 20 for producing extraction bags is prepared as shown in FIG. 5. For example, the thin plate-like members 10 are arranged on, and bonded to, a long water permeable filter sheet 21 at predetermined intervals with the first horizontal folding line Lh1 of the thin plate-like member 10 aligning with the long-side direction of the water permeable filter sheet 21. In this figure, a region interposed between long dashed double-short dashed lines is used to produce a single extraction bag.

Figure 6:
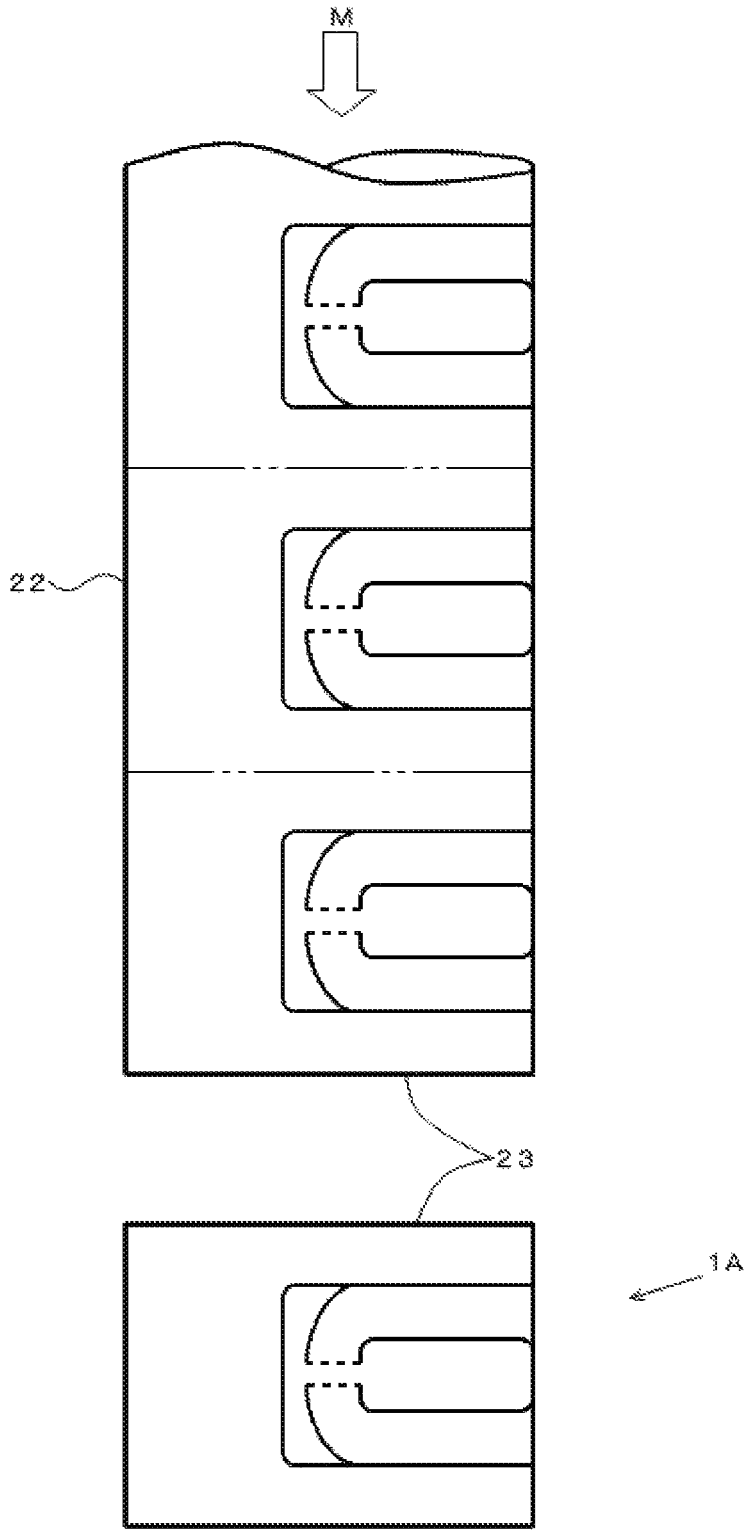
FIG. 6 is an explanatory view for a producing method of extraction bags.

The extraction bags 1A can be produced successively by using such a sheet 20 for producing extraction bags in a packaging and filling machine. In this case, the sheet 20 for producing extraction bags is first folded in half so that lateral sides thereof in the long-side direction of the sheet 20 for producing extraction bags are overlapped with each other as shown in FIG. 6. The lateral sides in the long-side direction are welded to form a vertical seal 22, thereby forming a tubular body. Thereafter, a continuous extraction bag form including the extraction bags 1A joined one above the other at the lateral sides of the bag main body 3 of the extraction bag 1A is produced by alternately repeating the formation of a horizontal seal 23 by which the tubular body is welded in the short-side direction thereof and the filling of an extraction material M in the bag main body 3. Such a continuous extraction bag form is separated off into individual extraction bags so as to obtain the extraction bags 1A. Alternatively, individually-separated extraction bags 1A are produced successively by performing cutting by melting simultaneously with the formation of the horizontal seal 23 in the short-side direction of the tubular body.

Modifications

Figure 7:
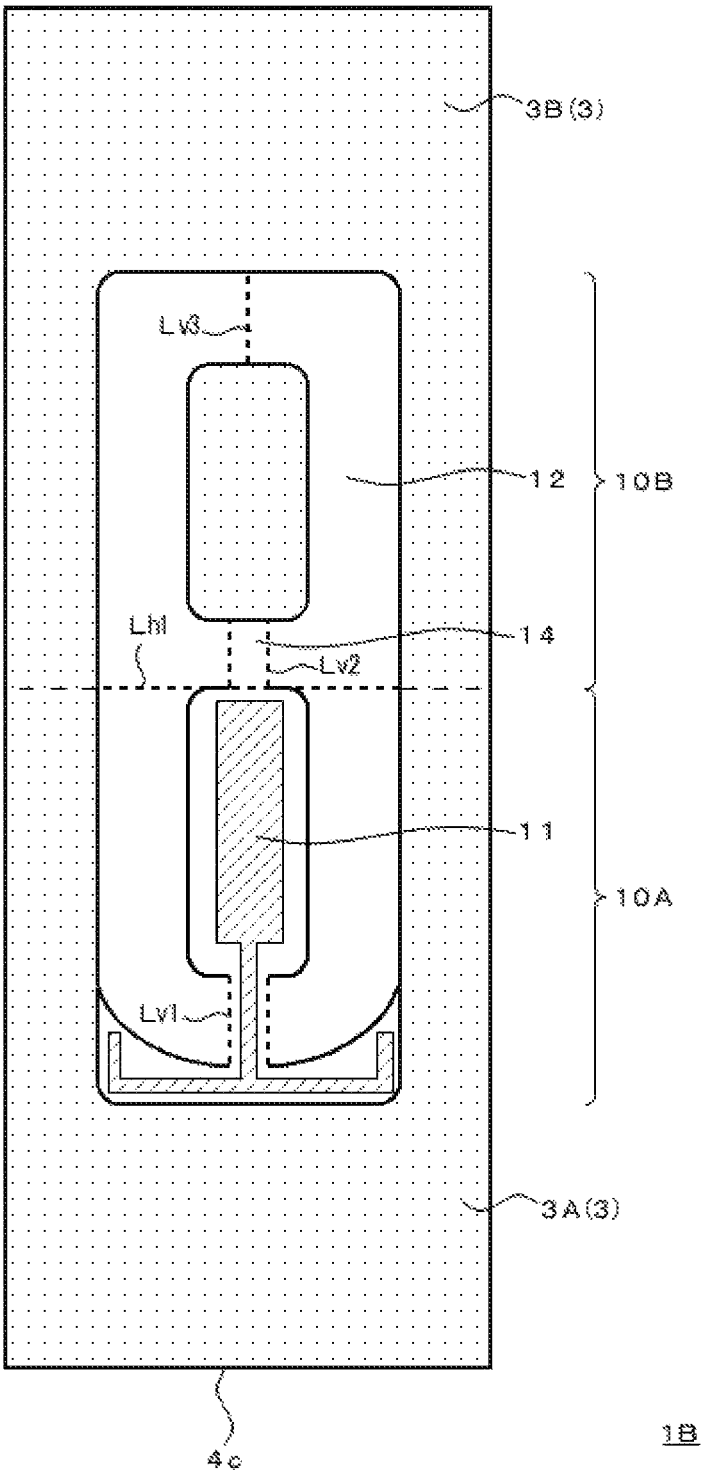
FIG. 7 is a developed view of an extraction bag 1B according to an embodiment.
Figure 8:
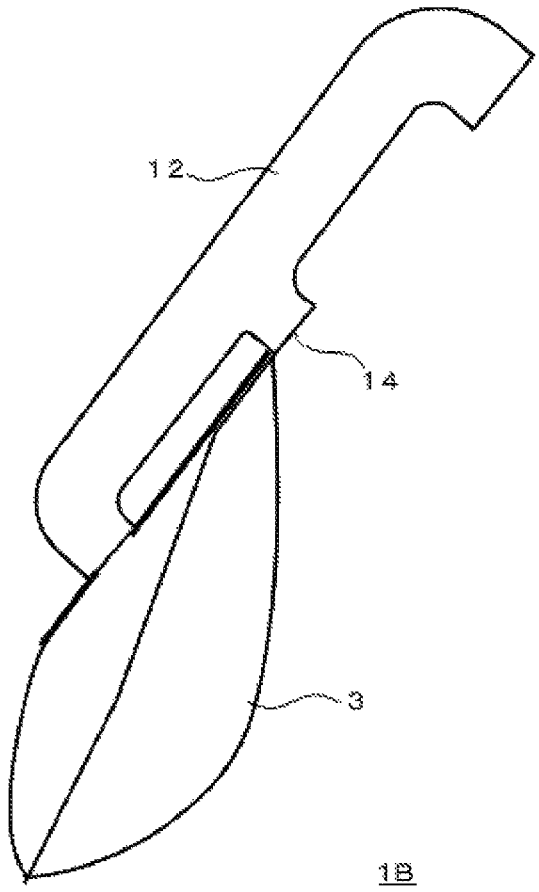
FIG. 8 is a side view of the extraction bag 1B according to the embodiment with the elongated regions being pulled out.

Various changes can be made to the extraction bag of the present invention. For example, an extraction bag 1B having a developed view shown in FIG. 7 differs from the extraction bag 1A having the developed view shown in FIG. 2 in that the central pull-up portion 15 is omitted and a part of the bag main body corresponding to that portion is exposed. According to this extraction bag 1B, the central bonded portion 11 of the bag main body 3 can be held by the stick-shaped portion formed by the pair of elongated regions 12 even when the stick-shaped portion is inclined as shown in FIG. 8. Thus, by inclining the stick-shaped portion when the extraction material is extracted, the shape of the portion occupied by the extraction material in the bag main body 3 can be changed so as to increase its upper surface, and its headspace can be also increased as compared to when the stick-shaped portion is vertically erected. Therefore, this extraction bag 1B also facilitates extraction from the entire extraction material in the bag main body.

Figure 9:
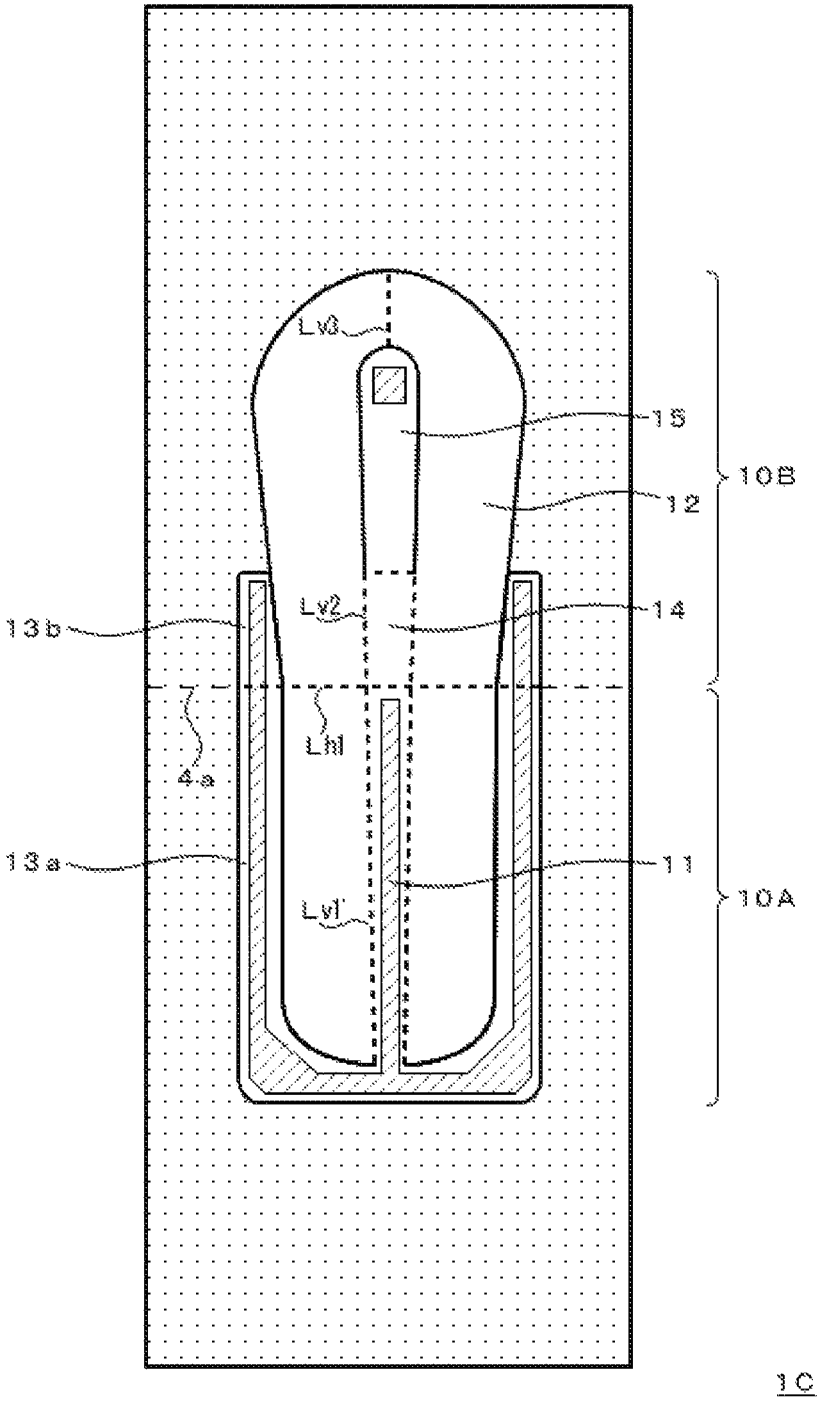
FIG. 9 is a developed view of an extraction bag 1C according to an embodiment.

An extraction bag 1C having a developed view shown in FIG. 9 differs from the extraction bag 1A having the developed view shown in FIG. 2 in that the elongated regions 12 provided on the right and left sides of the central bonded portion 11 in the first member via cut lines are continuous with each other via vertical folding lines Lv1'. The vertical folding lines Lv1' are those obtained by extending the second vertical folding lines Lv2 between the central upper end portion 14 and the elongated regions 12 provided on the right and left sides of the central upper end portion 14 in the second member 10B to the first member 10A. This increases the length of the portion serving as a rotary axis when the elongated regions 12 are pulled out and being held by the surface of the bag main body as compared to the extraction bag 1A having the developed view shown in FIG. 2, thus improving attachment strength of the stick-shaped portion formed by pulling out the pair of elongated regions 12 with respect to the bag main body 3.

Figure 10:
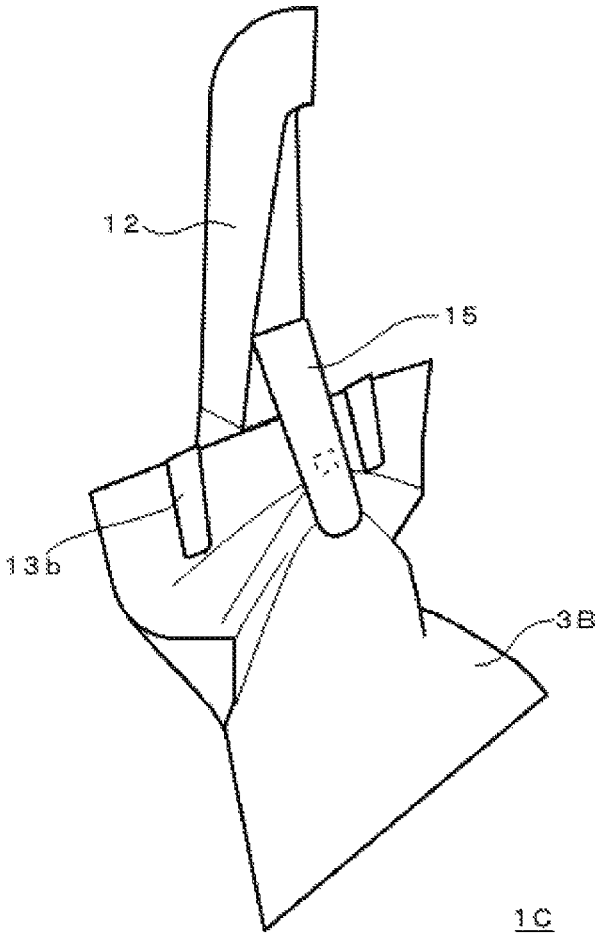
FIG. 10 is a perspective view illustrating the extraction bag 1C according to the embodiment with elongated regions being pulled out.

According to this extraction bag 1C, the first member 10A includes a reinforced portion 13*a* bonded to the bag main body 3 in an outer peripheral portion of the elongated regions 12. The reinforced portion 13*a* is extended to an upper portion of the second member 10B beyond the upper side 4*a* of the bag main body so as to form a reinforced portion 13*b* bonded to the bag main body also in the upper portion of the second member 10B. Consequently, when the elongated regions 12 are pulled out, the upper portion of the second surface 3B of the bag main body is held down by the reinforced portion 13*b*, and the second surface 3B of the bag main body is partially pulled up by the central pull-up portion 15 as shown in FIG. 10. This makes it easier to increase the headspace in the bag main body, thus further increasing the extraction rate.

Figure 11:
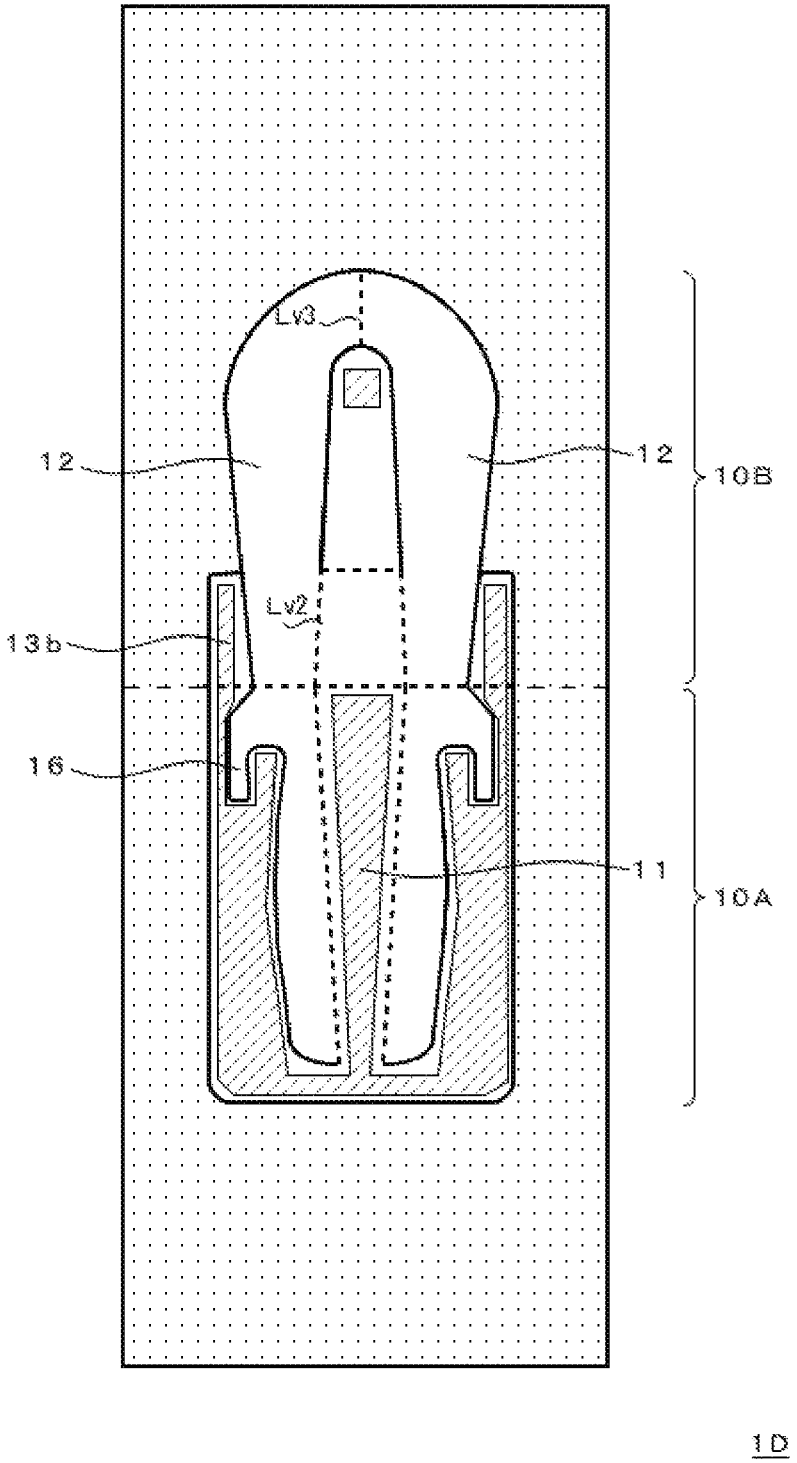
FIG. 11 is a developed view of an extraction bag 1D according to an embodiment.
Figure 12:
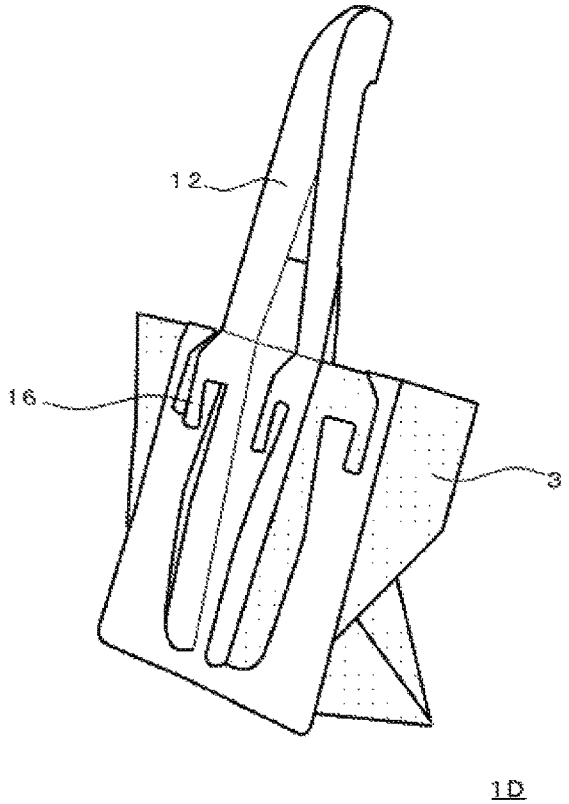
FIG. 12 is a perspective view illustrating the extraction bag 1D according to the embodiment with elongated regions being pulled out.
Figure 13:
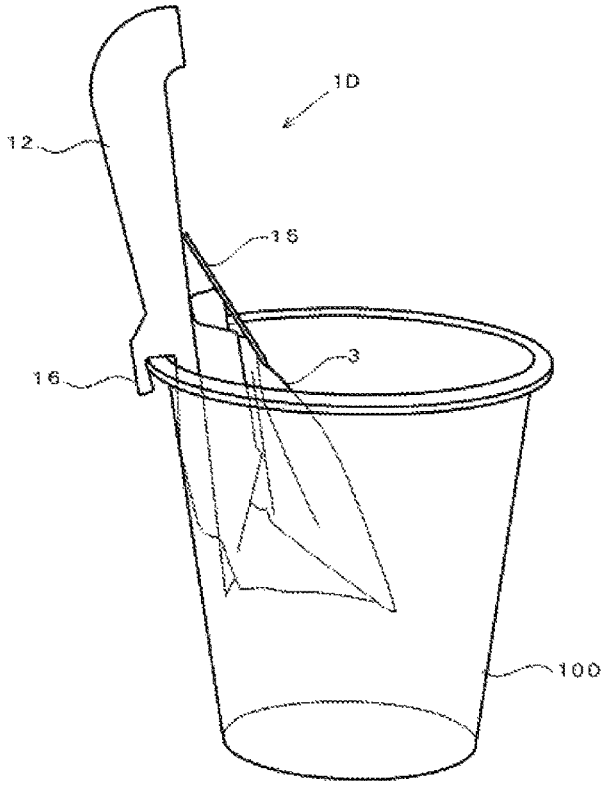
FIG. 13 is a perspective view illustrating the extraction bag 1D with the elongated regions being pulled out and with hooking portions 16 being hooked onto a cup.

An extraction bag 1D having a developed view shown in FIG. 11 differs from the extraction bag 1C having the developed view shown in FIG. 9 in that hooking portions 16, each protruded in an L shape, are provided in lateral side portions of the pair of elongated regions 12 in the first member 10A. When the elongated regions 12 are pulled out in the extraction bag 1D, the hooking portions 16 can protrude from the surface where the central bonded portion 11 is formed as shown in FIG. 12. Thus, the hooking portions 16 can be hooked onto a wall of an opening of a cup 100 during the extraction of the extraction material as shown in FIG. 13. This allows one's hands to get off of the extraction bag 1D while the bag main body 3 is immersed in hot water in the extraction. Before the disposal of the extracted extraction bag 1D, the extraction bag 1D may be hooked onto an empty cup in order to drain the extraction bag 1D.

Figure 14:
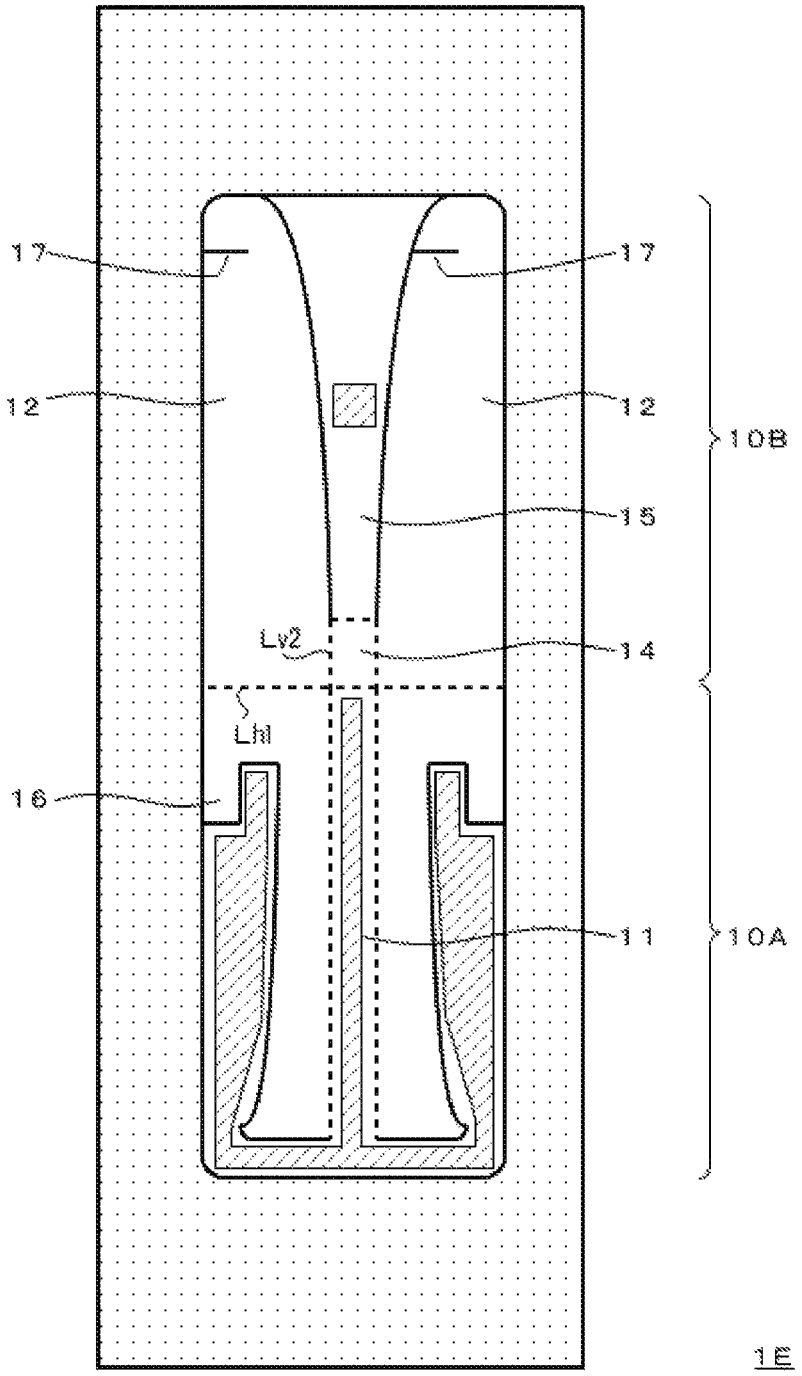
FIG. 14 is a developed view of an extraction bag 1E according to an embodiment.
Figure 15:
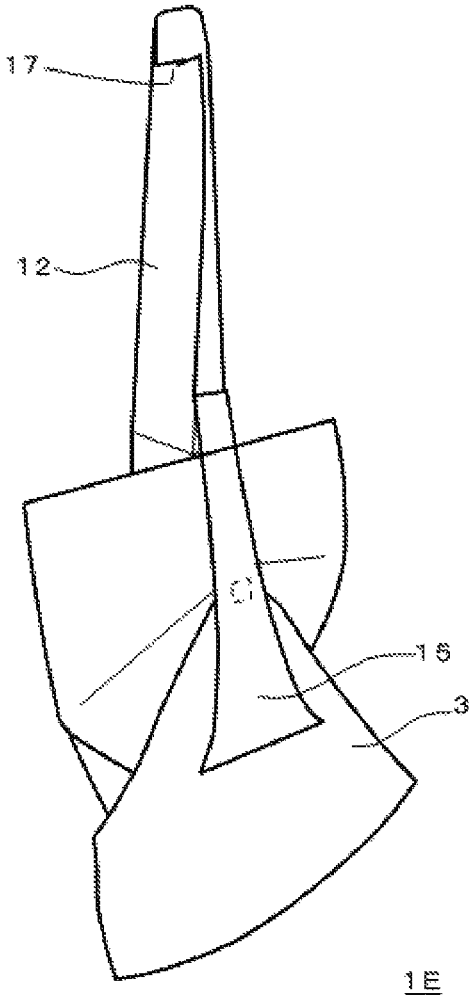
FIG. 15 is a perspective view illustrating the extraction bag 1E according to the embodiment with elongated regions being pulled out.

An extraction bag 1E having a developed view shown in FIG. 14 differs from the extraction bag 1D having the developed view shown in FIG. 11 in that ends of the pair of elongated regions in the second member 10B are independently provided without making the ends continuous with each other via the third vertical folding line Lv3. Moreover, the ends of the pair of elongated regions 12 in the second member 10B are provided with notches 17. Thus, the ends of the elongated regions 12 pulled out from the bag main body can be engaged with each other by the notches 17 as shown in FIG. 15. The elongated regions 12 serve as a rigid stick-shaped portion also in this extraction bag 1E.

Figure 16:
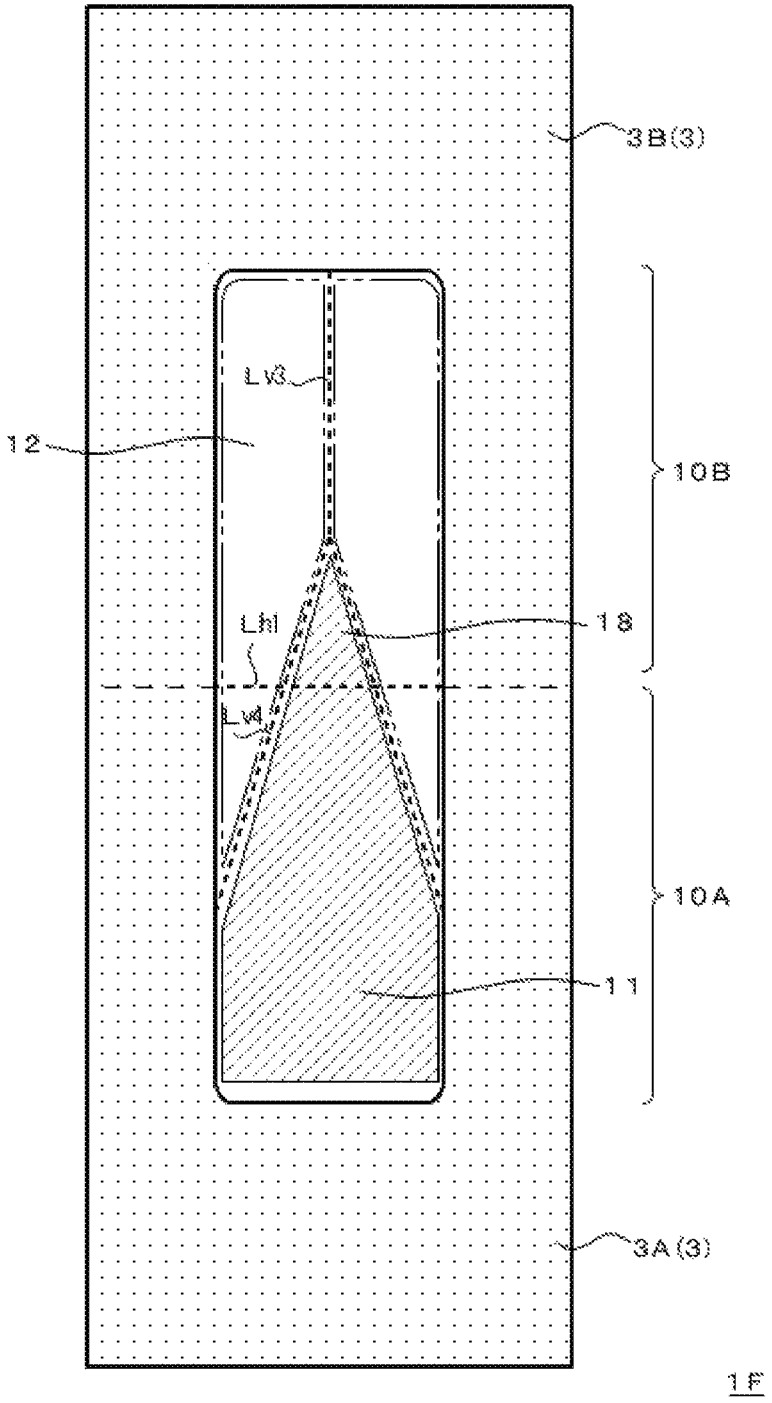
FIG. 16 is a developed view of an extraction bag 1F according to an embodiment.

Unlike the above-described extraction bags, an extraction bag 1F having a developed view shown in FIG. 16 includes no central pull-up portion 15, reinforced portions 13, 13*a*, and 13*b*, etc. The extraction bag 1F, however, includes the central bonded portion 11 in a central portion of the first member 10A, and the pair of elongated regions 12 interposing the central bonded portion 11 therebetween are formed astride the first member 10A and the second member 10B. Moreover, a pair of fourth vertical folding lines Lv4 formed obliquely to the long-side direction of the elongated regions 12 are provided between the central bonded portion 11 and the elongated regions 12.

Figure 17:
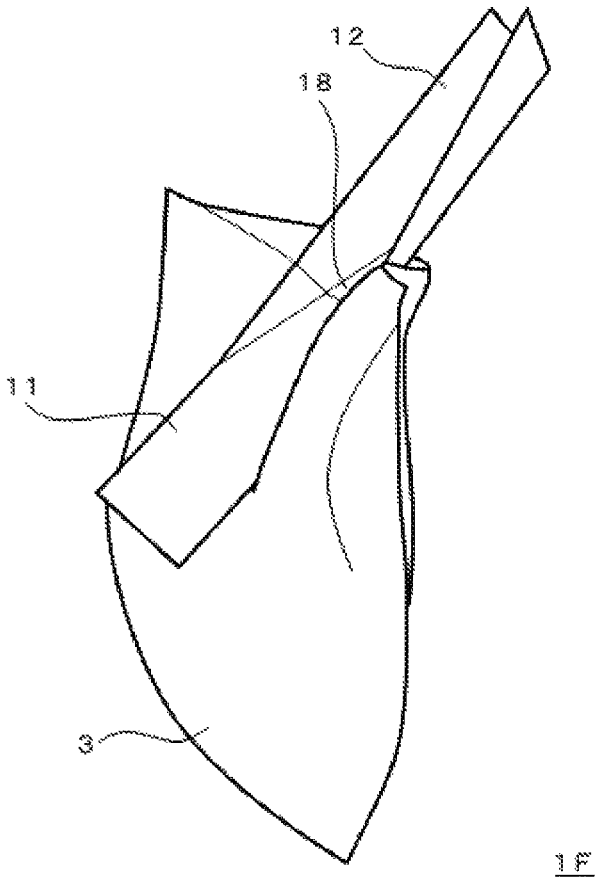
FIG. 17 is a perspective view illustrating the extraction bag 1F according to the embodiment with elongated regions being pulled out.

Also in this extraction bag 1F, a rigid stick-shaped portion extending from the first surface 3A of the bag main body can be formed by the elongated regions 12 as shown in FIG. 17 by pulling out the pair of elongated regions 12 from the bag main body 3 while folding the thin plate-like member along the vertical folding lines Lv3 and Lv4 so that the elongated regions 12 are opposed to each other. By gripping this stick-shaped portion, the bag main body 3 can be sunk into hot water or moved up and down in the hot water. Thus, the extraction rate can be increased.

Moreover, an upper bonded portion 18 bonded to the bag main body is formed in a portion interposed between the pair of elongated regions 12 in the second member 10B. Consequently, when the elongated regions 12 are pulled out so as to be opposed to each other, a middle portion of the bag main body expands as shown in FIG. 17, thus increasing the headspace. The extraction bag 1F can increase the extraction rate of the extraction material also by such expansion.

Figure 18:
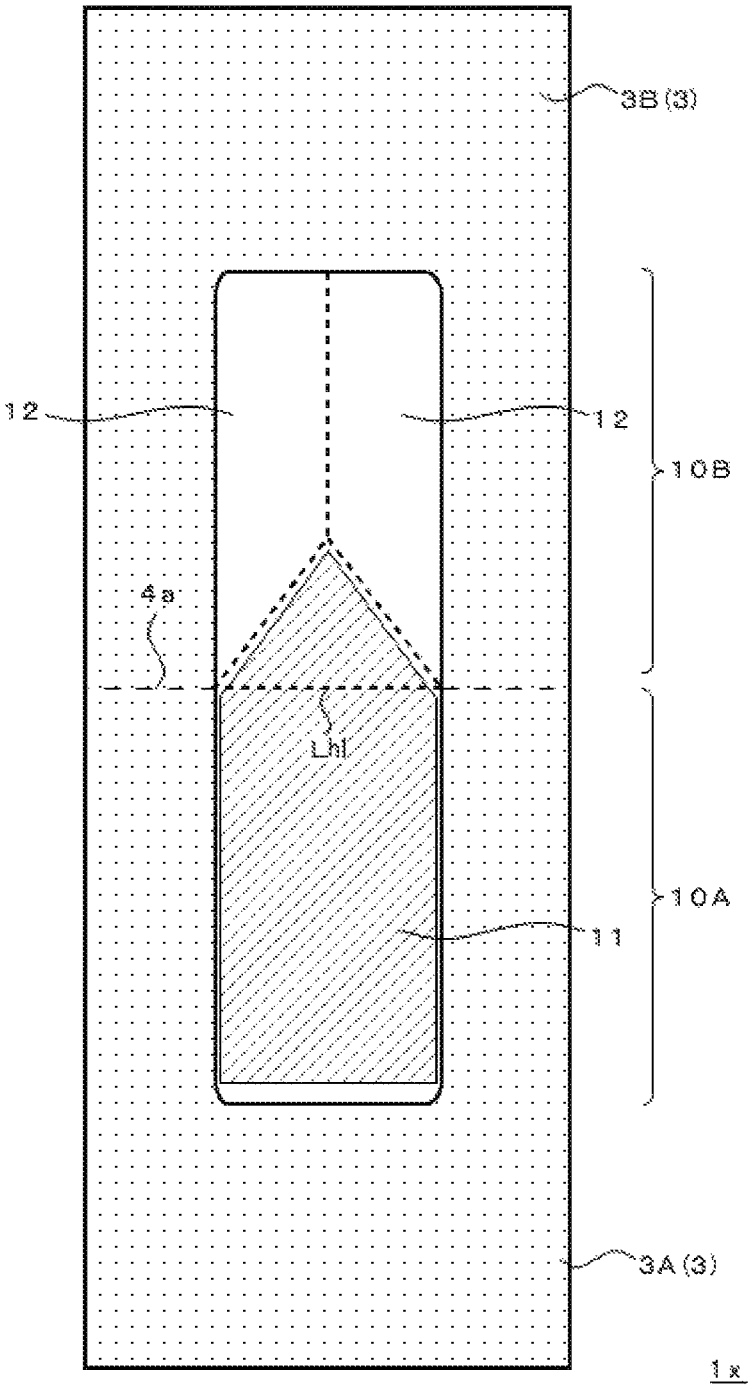
FIG. 18 is a developed view of an extraction bag 1*x* according to a comparative example.
Figure 19:
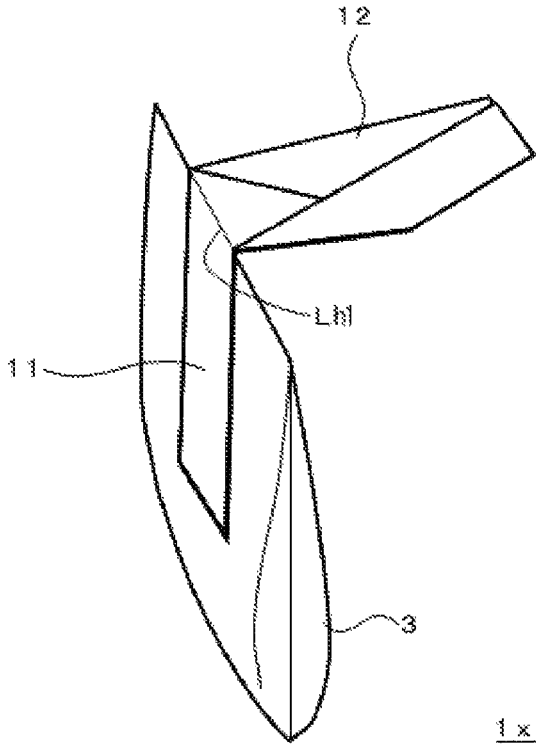
FIG. 19 is a perspective view illustrating the extraction bag 1*x* according to the comparative example with elongated regions being pulled out.

An extraction bag 1*x* having a developed view shown in FIG. 18 according to a comparative example differs from the extraction bag 1F having the developed view shown in FIG. 16 in that the pair of elongated regions 12 are formed only in the second member 10B. Consequently, when the pair of elongated regions 12 are pulled out from the bag main body so as to be opposed to each other, the first member 10A and the second member 10B are folded along the first horizontal folding line Lh1 as shown in FIG. 19. The bag main body 3 vertically suspends from the first horizontal folding line Lh1 while keeping a flattened state. This makes it difficult to sink the bag main body 3 in hot water or move the bag main body up and down in the hot water with the elongated regions 12 pulled out from the bag main body 3. Thus, the effects of the present invention cannot be obtained.

Figure 20:
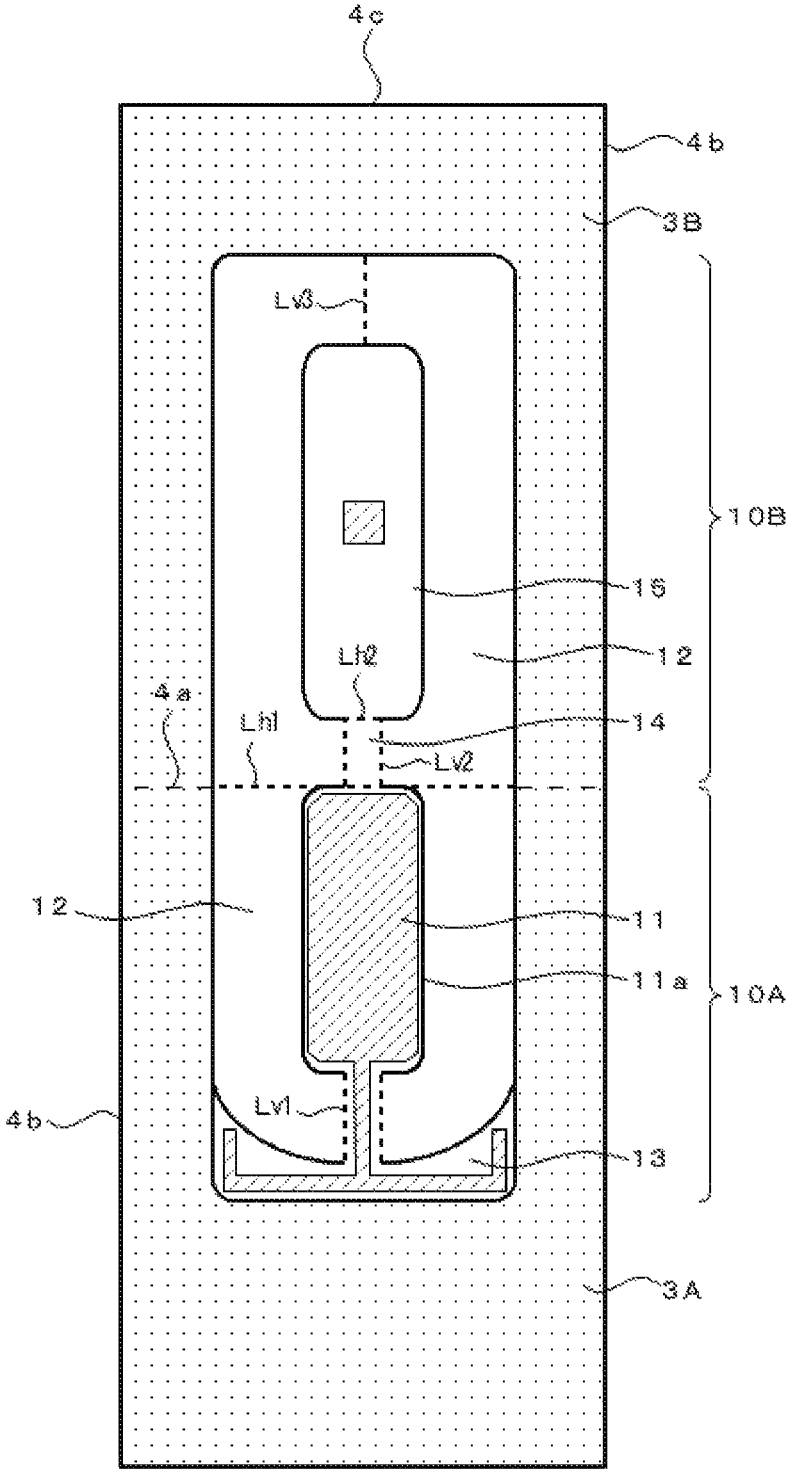
FIG. 20 is a developed view of an extraction bag 1G according to an embodiment.

Lengths of the first member and the second member in the long-side direction may be identical with, or different from, each other in the present invention. For example, in an extraction bag 1G having a developed view shown in FIG. 20, a portion capable of being gripped is elongated by extending the length of the second member in the above-described extraction bag 1A having the developed view of FIG. 2 toward the lower side 4*c* of the second surface 3B of the bag main body so as to increase the length of the elongated regions 12.

Hand-Filled Extraction Bag

A hand-filled extraction bag may be produced by leaving the bag main body 3 as an empty bag without filling the extraction material in the bag main body 3 in each of the above-described extraction bags 1A, 1B, 1C, 1D, 1E, 1F, and 1G and providing an opening used for filling an extraction material in the bag main body 3. With such a hand-filled extraction bag, an individual user of the extraction bag can fill the empty bag with an extraction material according to his or her taste, and its extraction liquid can be obtained.

Figure 21:
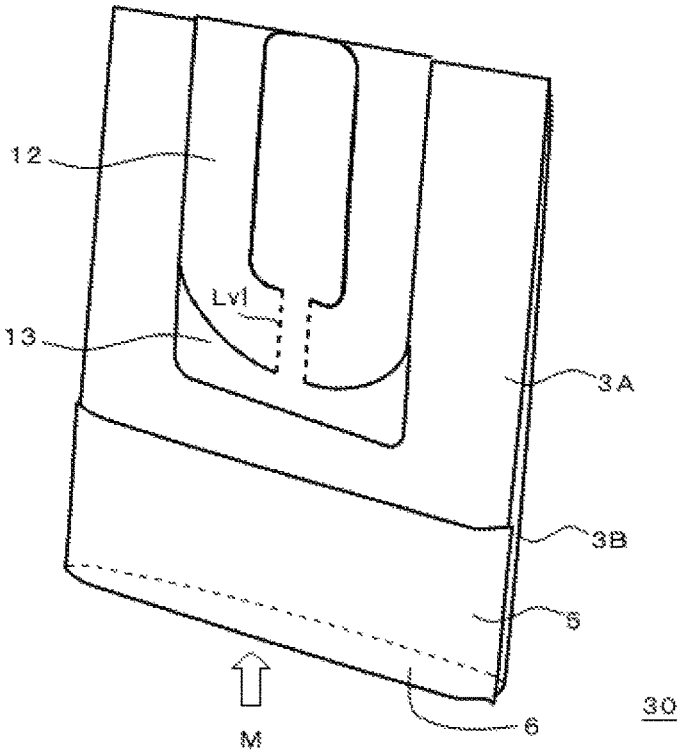
FIG. 21 is a perspective view illustrating a hand-filled extraction bag 30 according to an embodiment.
Figure 22:
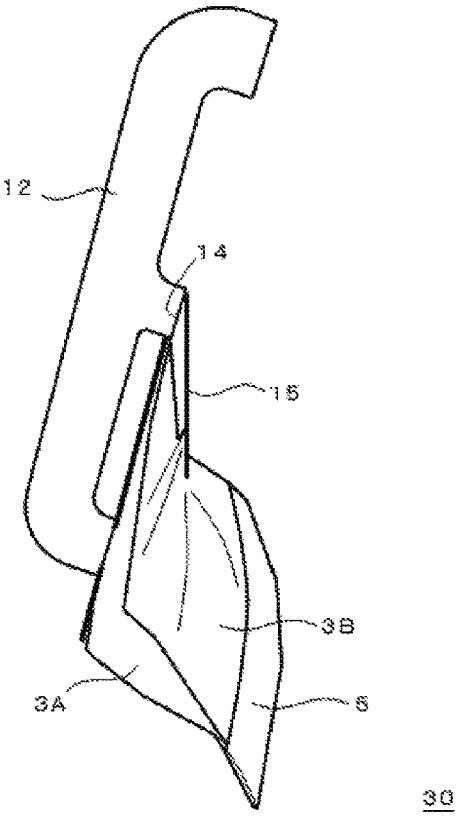
FIG. 22 is a perspective view illustrating the hand-filled extraction bag 30 according to the embodiment with an opening thereof being closed.

It is preferable that the opening of the hand-filled extraction bag be provided with a means to close the opening after an extraction material is filled. For example, as an empty hand-filled bag corresponding to the above-described extraction bag 1A, a fold-back portion 5 obtained by folding back the water permeable filter sheet that forms the first surface 3A toward the front surface side may be provided at a lower part of the first surface 3A of the bag main body 3, and an opening 6 may be provided without sealing the lower end of the bag main body 3 as in a hand-filled extraction bag 30 shown in FIG. 21. A user of the extraction bag can close the opening 6 as shown in FIG. 22 by inverting the front and back surfaces of the fold-back portion 5 after the extraction material M is filled by hand through the opening 6 of the bag main body 3, which is an empty bag.

The means to close the opening 6 of the empty bag is not limited to the provision of the fold-back portion 5 at the lower part of the bag main body 3. For example, a zipper described in Japanese Patent No. 4289363 may be provided in the opening 6, or a double-faced tape for food packaging may be used.

Although various aspects of the present invention have been described above, the changes in the various aspects may be combined as appropriate in the present invention.

REFERENCE SIGNS LIST

1A, 1B, 1C, 1D, 1E, 1F, 1G, 1*x* extraction bag
2 water permeable filter sheet
3 bag main body
3*a* upper side of bag main body
3A first surface
3B second surface
4*a* upper side
4*b* lateral side
4*c* lower side
5 fold-back portion
6 opening
10 thin plate-like member
10A first member
10B second member
11 central bonded portion
11*a* lateral side of central bonded portion
12 elongated region
13, 13*a*, 13*b* reinforced portion
14 central upper end portion
15 central pull-up portion
15A bonded region
16 hooking portion
17 notch
18 upper bonded portion
20 sheet for producing extraction bags
21 long water permeable filter sheet
22 vertical seal
23 horizontal seal
30 hand-filled extraction bag
100 cup
Lh1 first horizontal folding line
Lh2 second horizontal folding line
Lv1 first vertical folding line
Lv1' vertical folding line
Lv2 second vertical folding line
Lv3 third vertical folding line
Lv4 fourth vertical folding line
M extraction material

The invention claimed is:

1. An extraction bag comprising: a bag main body formed of a water permeable filter sheet; a plate member provided on an outer surface of the bag main body; and an extraction material filled in the bag main body, wherein the bag main body includes a first surface and a second surface opposed to each other, and an upper side at which an edge of the first surface and an edge of the second surface are joined together, the bag main body extending in (i) a lengthwise direction from the upper side to a lower side, and (ii) a widthwise direction between lateral sides of the bag main body, the lengthwise direction being orthogonal to the widthwise direction;

the plate member includes a first member on the first surface of the bag main body, and a second member on the second surface of the bag main body, the first member and the second member being continuous with each other via a first horizontal folding line extending along the upper side;

the first member includes a central bonded portion bonded to the first surface of the bag main body in a central portion of the first member, the plate member includes a pair of elongated regions that:

extend continuously from the first member to the second member through the first horizontal folding line, include vertical folding lines extending between the pair of elongated regions, and are configured to be:

pulled out from the second surface of the bag main body so as to rotate around the first horizontal folding line and extend in a direction toward the lateral sides of the bag main body, and then folded along the vertical folding lines such that the pair of elongated regions are rotated with respect to the bag main body around the vertical folding lines so as to move from a position sandwiching lateral sides of the central bonded portion of the first member along the widthwise direction of the bag main body and facing away from the first surface of the bag main body to a position facing towards each other, wherein the second member includes, between the pair of elongated regions, a central upper end portion that extends from the first horizontal folding line and is continuous with the pair of elongated regions via the vertical folding lines, and wherein only the first member of the first and second member includes a reinforced portion that is continuous with the central bonded portion of the first member by being bonded to the bag main body in an outer peripheral portion of the pair of elongated regions.

2. The extraction bag according to claim 1, wherein ends of the pair of elongated regions in the second member are continuous with each other via another vertical folding line.

3. The extraction bag according to claim 1, wherein the lateral sides of the central bonded portion of the first member are separable from the pair of elongated regions, and the vertical folding lines are formed in the first member at a position closer to a lower side of the bag main body than the central bonded portion is to the lower side of the bag main body.

4. The extraction bag according to claim 1, wherein the reinforced portion is closer to a lower side of the bag main body than the pair of elongated regions is to the lower side of the bag main body.

5. The extraction bag according to claim 1, wherein the reinforced portion extends along a periphery of the pair of elongated regions and extends into the second member through the upper side.

6. The extraction bag according to claim 1, wherein the first member includes hooking portions which are each protruded in an L shape and provided in lateral side portions of each of the pair of elongated regions.

7. The extraction bag according to claim 1, wherein the vertical folding lines extend in a direction that is parallel to or oblique to the lengthwise direction of the bag main body.

8. The extraction bag according to claim 1, wherein the pair of elongated regions are fixed to the first surface of the bag main body by being connected to a region bonded to the first surface that is positioned below the central bonded portion of the first member and between the vertical folding lines.

9. The extraction bag according to claim 1, wherein the second member further includes, between the pair of elongated regions, a central pull-up portion that is separable from the elongated regions but is continuous with the central upper end portion via a folding line, wherein the central pull-up portion is not bonded to the bag main body except at a position that is spaced from the central upper end portion, the position spaced from the central upper end portion is completely surrounded by the central pull-up portion that is not bonded to the bag main body.

10. The extraction bag according to claim 1, wherein the second member is not bonded to the bag main body at any part of the second member.

11. The extraction bag according to claim 1, wherein only the reinforced portion and the central bonded portion of the first member are bonded to the bag main body.

12. A fillable extraction bag comprising: a bag main body formed of a water permeable filter sheet; and a plate member provided on an outer surface of the bag main body, wherein the bag main body is capable of being filled with an extraction material and an opening for filling the extraction material is provided in the bag main body;

the bag main body includes a first surface and a second surface opposed to each other, and an upper side at which an edge of the first surface and an edge of the second surface are joined together, the bag main body extending in (i) a lengthwise direction from the upper side to a lower side, and (ii) a widthwise direction between lateral sides of the bag main body, the lengthwise direction being orthogonal to the widthwise direction;

the plate member includes a first member on the first surface of the bag main body, and a second member on the second surface of the bag main body, the first member and the second member being continuous with each other via a first horizontal folding line extending along the upper side;

the first member includes a central bonded portion bonded to the first surface of the bag main body in a central portion of the first member, the plate member includes a pair of elongated regions that:

extend continuously from the first member to the second member through the first horizontal folding line, include vertical folding lines extending between the pair of elongated regions, and are configured to be:

pulled out from the second surface of the bag main body so as to rotate around the first horizontal folding line and extend in a direction toward the lateral sides of the bag main body, and then folded along the vertical folding lines such that the pair of elongated regions are rotated with respect to the bag main body around the vertical folding lines so as to move from a position sandwiching lateral sides of the central bonded portion of the first member along the widthwise direction of the bag main body and facing away from the first surface of the bag main body to a position facing towards each other, wherein the second member includes, between the pair of elongated regions, a central upper end portion that extends from the first horizontal folding line and is continuous with the pair of elongated regions via the vertical folding lines, and wherein only the first member of the first and second member includes a reinforced portion that is continuous with the central bonded portion of the first member by being bonded to the bag main body in an outer peripheral portion of the pair of elongated regions.

13. The fillable extraction bag according to claim 12, wherein the opening is provided at a lower end of the bag main body.

14. The fillable extraction bag according to claim 12, wherein the second member further includes, between the pair of elongated regions, a central pull-up portion that is separable from the elongated regions but is continuous with the central upper end portion via a folding line, wherein the central pull-up portion is not bonded to the bag main body except at a position that is spaced from the central upper end portion, the position spaced from the central upper end portion is completely surrounded by the central pull-up portion that is not bonded to the bag main body.

15. The fillable extraction bag according to claim 12, wherein the second member is not bonded to the bag main body at any part of the second member.

16. The fillable extraction bag according to claim 12, wherein only the reinforced portion and the central bonded portion of the first member are bonded to the bag main body.

* * * * *